US011139545B2

(12) United States Patent
Zhang et al.

(10) Patent No.: US 11,139,545 B2
(45) Date of Patent: Oct. 5, 2021

(54) DIELECTRIC TUNING ELEMENT

(71) Applicant: NOKIA SHANGHAI BELL CO., LTD., Shanghai (CN)

(72) Inventors: Yunchi Zhang, Wallingford, CT (US); Jari Taskila, Meriden, CT (US)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 0 days.

(21) Appl. No.: 16/527,995

(22) Filed: Jul. 31, 2019

(65) Prior Publication Data

US 2021/0036390 A1 Feb. 4, 2021

(51) Int. Cl.
*H01P 1/205* (2006.01)
*H01P 7/04* (2006.01)

(52) U.S. Cl.
CPC ..... *H01P 1/2053* (2013.01); *H01P 7/04* (2013.01)

(58) Field of Classification Search
CPC ..... H01P 7/04; H01P 1/2053
USPC ..... 333/219
See application file for complete search history.

(56) References Cited

U.S. PATENT DOCUMENTS 6,600,393 B1 * 7/2003 Pahlman ..... H01P 1/205 333/203
6,806,791 B1 * 10/2004 Wang ..... H01P 1/2138 333/134
2015/0288043 A1 * 10/2015 Buchauer ..... H01P 1/2053 333/207

* cited by examiner

*Primary Examiner* — Robert J Pascal
*Assistant Examiner* — Kimberly E Glenn
(74) *Attorney, Agent, or Firm* — Squire Patton Boggs (US) LLP

(57) ABSTRACT

Apparatuses, methods of assembling a resonator, and methods of tuning a resonator are provided. An example apparatus may include at least one resonator comprising a resonator hole defined within the resonator and defining an inner wall of the at least one resonator, a tuning cover comprising at least one hollow rod, and a tuning element comprising a bottom flanged portion. The tuning element may be configured to be inserted into the at least one hollow rod and the bottom flanged portion is configured to cover at least a bottom portion of the hollow rod. The bottom flanged portion of the tuning element is configured to be positioned between the at least one hollow rod and the inner wall of the at least one resonator.

19 Claims, 10 Drawing Sheets

DIELECTRIC TUNING ELEMENT

FIELD

Some example embodiments may generally relate to resonators, filters and/or multiplexers. For example, certain embodiments may relate to designs for resonators that may be used in filters and/or multiplexers that may be employed, e.g., in mobile or wireless telecommunication systems.

BACKGROUND

Examples of mobile or wireless telecommunication systems may include the Universal Mobile Telecommunications System (UNITS) Terrestrial Radio Access Network (UTRAN), Long Term Evolution (LTE) Evolved UTRAN (E-UTRAN), LTE-Advanced (LTE-A), MulteFire, LTE-A Pro, and/or fifth generation (5G) radio access technology or new radio (NR) access technology. Filters, such as cavity filters, and multiplexers are often employed for base station applications in such communications systems. Compact and excellent passive intermodulation (PIM) performance filters and multiplexers are preferred, especially now for small cell and antenna dipole multiplexer applications. However, traditional cavity resonators used in filters and multiplexers may be too large and very PIM-sensitive for these applications.

SUMMARY

One embodiment is directed to an apparatus that may include at least one resonator comprising a resonator hole defined within the at least one resonator and defining an inner wall of the at least one resonator. The apparatus may also include a tuning cover comprising at least one hollow rod, and a tuning element comprising a bottom flanged portion. The tuning element is configured to be inserted into the at least one hollow rod and the bottom flanged portion is configured to cover at least a bottom portion of the hollow rod, and the bottom flanged portion of the tuning element is configured to be positioned between the at least one hollow rod and the inner wall of the at least one resonator.

In an embodiment, the at least one hollow rod comprises a threaded chamber formed therein, and the tuning element is configured to be screwed into the threaded chamber.

In an embodiment, the at least one hollow rod may be at least one of embedded into the tuning cover or monolithic with the tuning cover.

In an embodiment, the tuning element comprises a dielectric tuning element. In an embodiment, the dielectric material of the tuning element is configured to reduce cavity and/or resonator size and improve passive intermodulation performance (e.g., compared to metallic tuning element) by increasing capacitance between the at least one hollow rod and the inner wall of the resonator hole.

In an embodiment, the tuning element is configured to be movable up and down to adjust a resonant frequency of the apparatus.

In an embodiment, the tuning element is configured to increase a capacitance between the at least one hollow rod of the tuning cover and the at least one resonator.

In an embodiment, the bottom flanged portion of the tuning element may be shaped cylindrically.

Another embodiment is directed to a filter that may include at least one resonator comprising a resonator hole defined within the at least one resonator and defining an inner wall of the at least one resonator. The apparatus may also include a tuning cover comprising at least one hollow rod, and a tuning element comprising a bottom flanged portion. The tuning element is configured to be inserted into the at least one hollow rod and the bottom flanged portion is configured to cover at least a bottom portion of the hollow rod, and the bottom flanged portion of the tuning element is configured to be positioned between the at least one hollow rod and the inner wall of the at least one resonator.

Another embodiment is directed to a multiplexer that may include at least one resonator comprising a resonator hole defined within the at least one resonator and defining an inner wall of the at least one resonator. The apparatus may also include a tuning cover comprising at least one hollow rod, and a tuning element comprising a bottom flanged portion. The tuning element is configured to be inserted into the at least one hollow rod and the bottom flanged portion is configured to cover at least a bottom portion of the hollow rod, and the bottom flanged portion of the tuning element is configured to be positioned between the at least one hollow rod and the inner wall of the at least one resonator.

Another embodiment is directed to a method of assembling a resonator. The method may include providing a resonator comprising a resonator hole defined within the resonator and defining an inner wall of the resonator, providing a tuning cover comprising at least one hollow rod, and inserting a tuning element comprising a bottom flanged portion into the at least one hollow rod such that the bottom flanged portion is positioned between the at least one hollow rod and the inner wall of the resonator.

In an embodiment, the method may also include moving the tuning element up and down to adjust a resonant frequency of the resonator. In an embodiment, the tuning element is configured to increase a capacitance between the hollow rod of the tuning cover and the resonator.

In an embodiment, the at least one hollow rod comprises a threaded chamber formed therein, and the inserting of the tuning element comprises screwing the tuning element into the threaded chamber.

Another embodiment is directed to a method of tuning a resonator. The method may include providing a resonator comprising a resonator hole defined within the resonator and defining an inner wall of the resonator, providing a tuning cover comprising at least one hollow rod, and providing a tuning element comprising a bottom flanged portion. The method may also include inserting the tuning element into the at least one hollow rod of the tuning cover such that the bottom flanged portion of the tuning element is positioned between the at least one hollow rod and the inner wall of the resonator, and adjusting a resonant frequency of the resonator by moving the tuning element up and down.

BRIEF DESCRIPTION OF THE DRAWINGS

For proper understanding of example embodiments, reference should be made to the accompanying drawings, wherein.

DETAILED DESCRIPTION

It will be readily understood that the components of certain example embodiments, as generally described and illustrated in the figures herein, may be arranged and designed in a wide variety of different configurations. Thus, the following detailed description of some example embodiments of a dielectric tuning element that reduces the size and improves PIM performance of filters and/or multiplexers, is not intended to limit the scope of certain embodiments but is representative of selected example embodiments.

The features, structures, or characteristics of example embodiments described throughout this specification may be combined in any suitable manner in one or more example embodiments. For example, the usage of the phrases "certain embodiments," "some embodiments," or other similar language, throughout this specification refers to the fact that a particular feature, structure, or characteristic described in connection with an embodiment may be included in at least one embodiment. Thus, appearances of the phrases "in certain embodiments," "in some embodiments," "in other embodiments," or other similar language, throughout this specification do not necessarily all refer to the same group of embodiments, and the described features, structures, or characteristics may be combined in any suitable manner in one or more example embodiments.

Additionally, if desired, the different functions or procedures discussed below may be performed in a different order and/or concurrently with each other. Furthermore, if desired, one or more of the described functions or procedures may be optional or may be combined. As such, the following description should be considered as merely illustrative of the principles and teachings of certain example embodiments, and not in limitation thereof.

Heavily loaded re-entrance-hole rod resonators and/or large-diameter mushroom top resonators are often used to reduce filter and/or multiplexer size. For a heavily loaded re-entrance-hole rod resonator (e.g., where tuning element is inserted deeply into re-entrance hole), the resonator depth is still quite large even though the resonator is heavily loaded. Large-diameter mushroom top resonators require a large cavity envelope to accommodate the resonator physically. Therefore, this tends to generate a large envelope filter and/or multiplexer. For both cases, the grounding contact between the tuning cover and metallic tuning element is very sensitive for PIM performance.

As such, there is a need for novel designs that are able to miniaturize the filters and multiplexers and provide excellent PIM performance. Some example embodiments provide a dielectric tuning element within a cavity resonator design in a manner that reduces the cavity size and improves PIM performance.

Figure 1B:
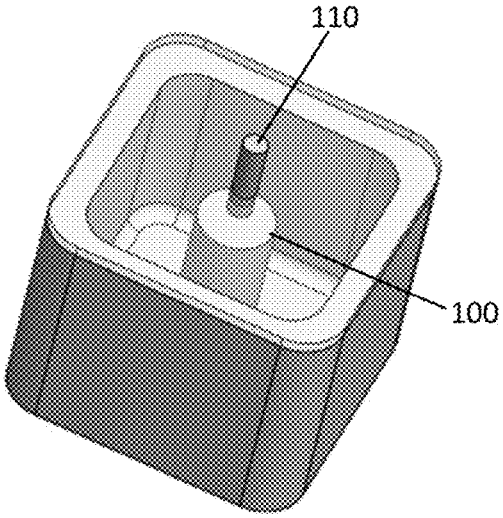
FIG. 1*b* illustrates a 3-dimensional top view of a coaxial rod resonator, according to one example.
Figure 1A:
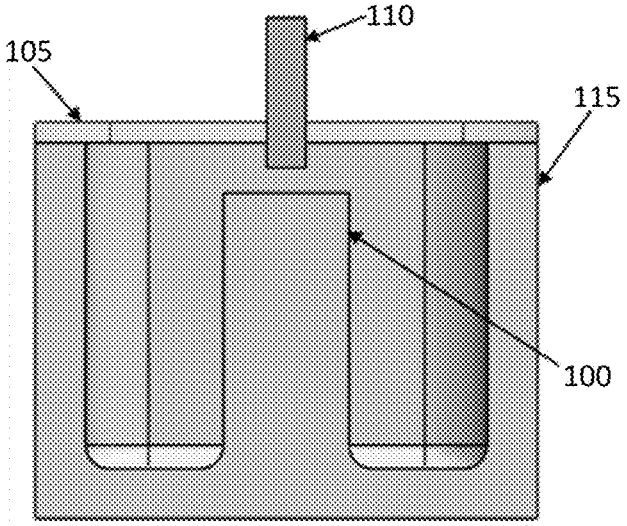
FIG. 1*a* illustrates a cross sectional view of a coaxial rod resonator, according to one example.

As introduced above, coaxial rod resonators, re-entrance-hole rod resonators, and mushroom top resonators are examples of resonator types that may be employed in cavity filter and/or multiplexer designs. FIGS. 1*a* and 1*b* illustrate an example of a coaxial rod resonator, according to an embodiment. More specifically, FIG. 1*a* depicts a cross sectional view of the coaxial rod resonator and FIG. 1*b* depicts a 3-dimensional top view of the coaxial rod resonator. As illustrated in the example of FIGS. 1*a* and 1*b*, the coaxial rod resonator may include a tuning cover 105, tuning element 110, cavity 115 and coaxial rod resonator 100.

Figure 2B:
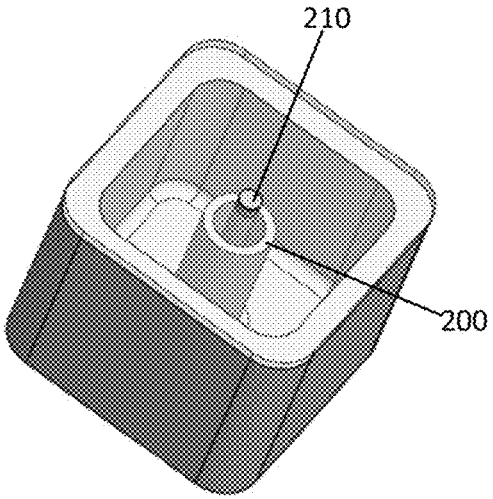
FIG. 2*b* illustrates a 3-dimensional top view of a re-entrant hole rod resonator, according to one example.
Figure 2A:
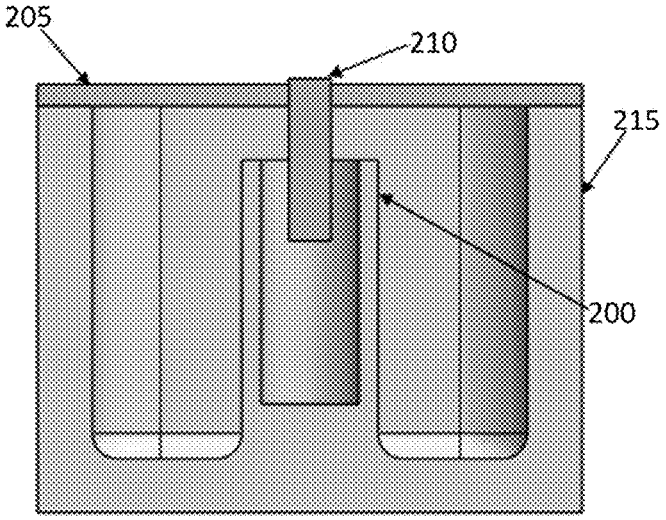
FIG. 2*a* illustrates a cross sectional view of a re-entrant hole rod resonator, according to one example.

FIGS. 2*a* and 2*b* illustrate an example of a re-entrant hole rod resonator, according to an embodiment. More specifically, FIG. 2*a* depicts a cross sectional view of the re-entrant hole rod resonator and FIG. 2*b* depicts a 3-dimensional top view of the re-entrant hole rod resonator. As illustrated in the example of FIGS. 2*a* and 2*b*, the re-entrant hole rod resonator may include a tuning cover 205, tuning element 210, cavity 215 and re-entrant hole rod resonator 200.

Figure 3B:
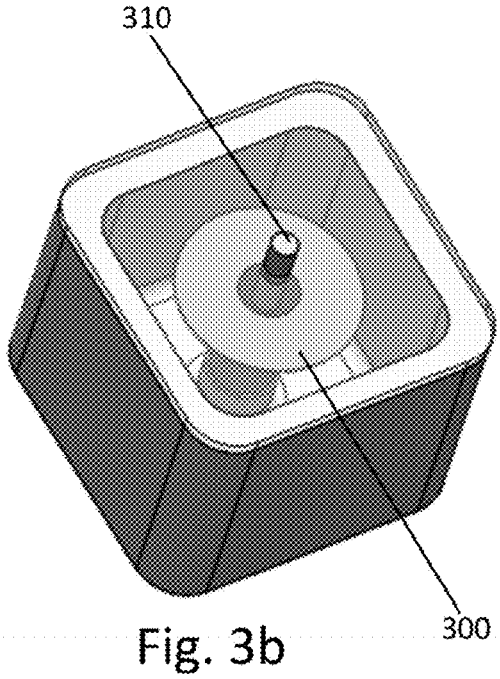
FIG. 3*b* illustrates a 3-dimensional top view of a mushroom top resonator, according to one example.
Figure 3A:
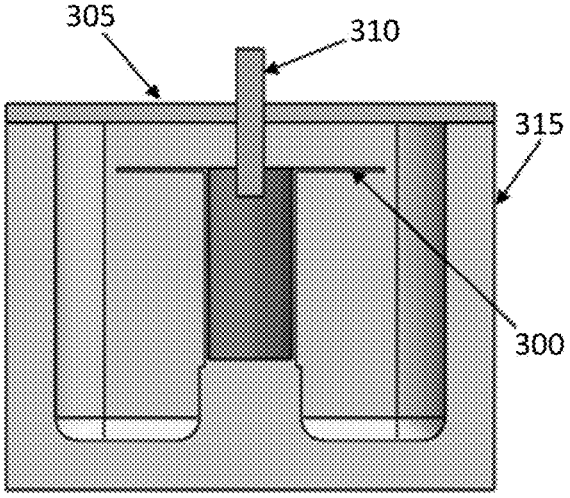
FIG. 3*a* illustrates a cross sectional view of a mushroom top resonator, according to one example.

FIGS. 3*a* and 3*b* illustrate an example of a mushroom top resonator, according to an embodiment. More specifically, FIG. 3*a* depicts a cross sectional view of the mushroom top resonator and FIG. 3*b* depicts a 3-dimensional top view of the mushroom top resonator. As illustrated in the example of FIGS. 3*a* and 3*b*, the mushroom top resonator may include a tuning cover 305, tuning element 310, cavity 315 and mushroom resonator 300.

However, for small cell, antenna dipole multiplexers, and/or other applications that require a compact filter or multiplexer size, the resonator designs discussed above in connection with FIGS. 1*a*-3*b* may be too bulky or large. This, in turn, results in large filter or multiplexer designs.

Further, it should be noted that the grounding contact between the metallic tuning element and tuning cover of a resonator is important for PIM performance due to the strong electric field on the resonator top, especially when the gap between the resonator top and the tuning cover gets smaller. In this case, a high tolerance part and feature may be needed on the tuning elements to provide good and stable PIM performance. Mass production PIM first pass yield is affected significantly by this contact.

In view of the above, certain embodiments provide a dielectric tuning element, for example, that is configured to miniaturize the resonator size, as well as reduce filter and/or multiplexer size. Moreover, example embodiments may be PIM free since grounding is not required.

Figure 4A:
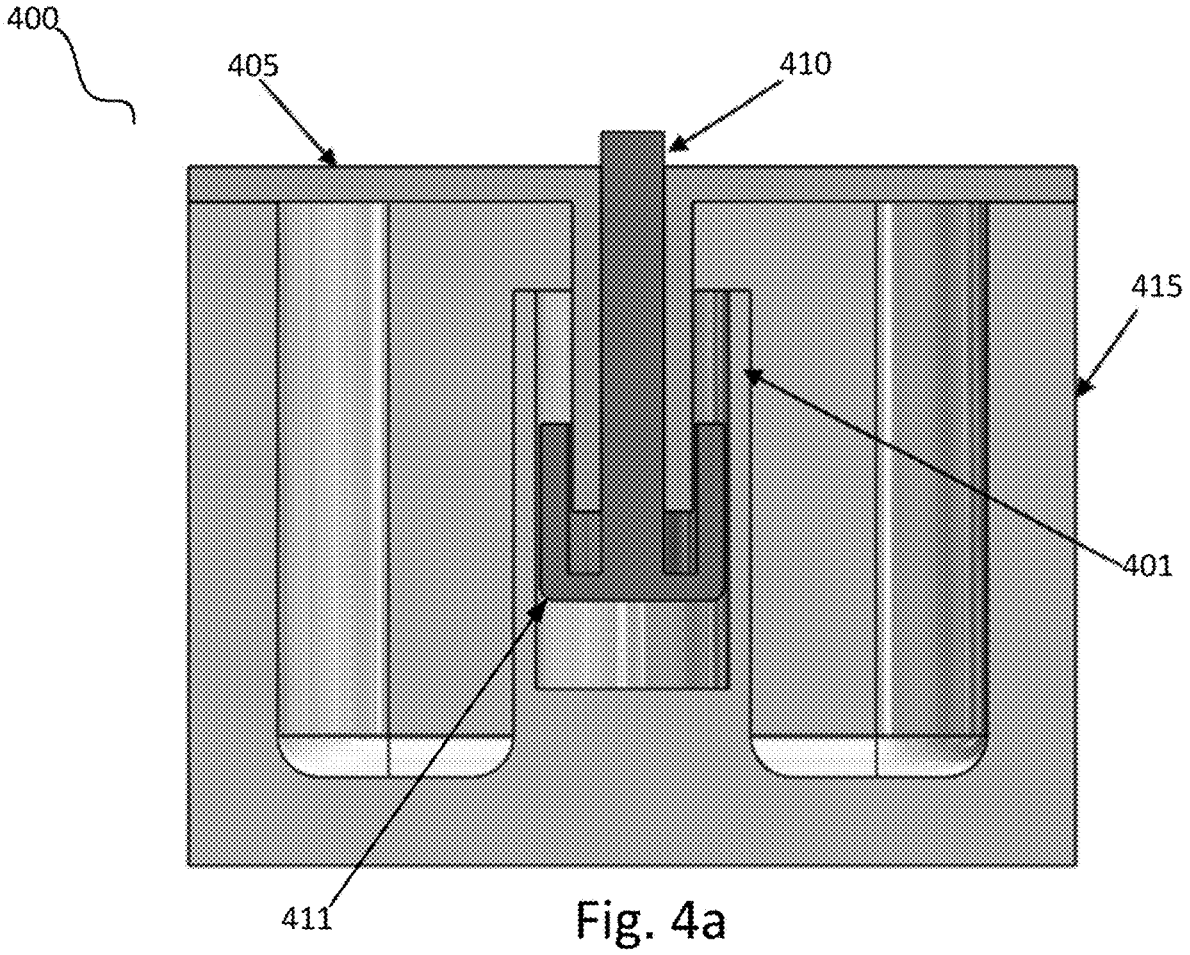
FIG. 4*a* illustrates a cross sectional view of a resonator, according to an embodiment.
Figure 4B:
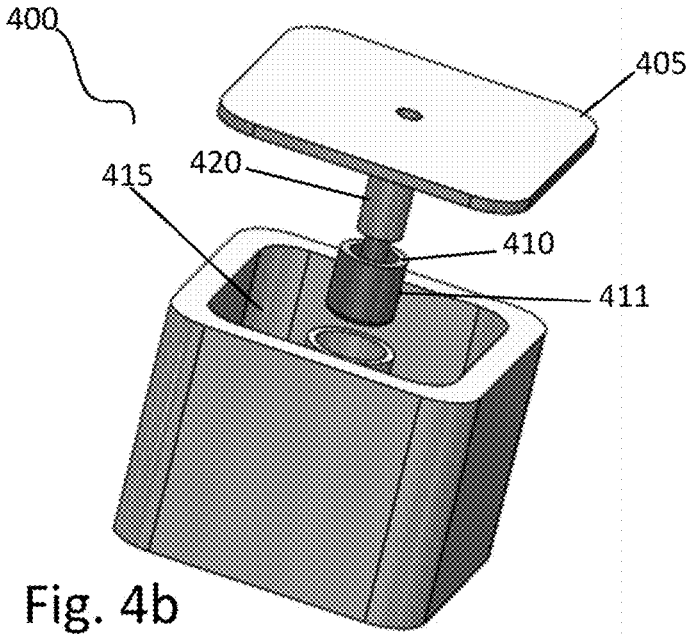
FIG. 4*b* illustrates a 3-dimensional top view of a resonator, according to an embodiment.

FIGS. 4*a* and 4*b* illustrate a structure of an example apparatus, according to certain embodiments. For instance, FIG. 4*a* depicts a cross sectional view of a resonator 400 and FIG. 4*b* depicts a 3-dimensional top view of the resonator 400, according to some embodiments.

The example of FIGS. 4*a* and 4*b* depicts a re-entrant hole rod resonator 400 that may include a cavity 415. In an embodiment, the resonator 400 may include a resonator hole defined within the resonator 400 and defining an inner wall 401 of the resonator 400. It is noted that, while the example of FIGS. 4*a* and 4*b* depicts a re-entrant hole rod resonator, example embodiments are not limited to this type of resonator. For example, certain embodiments may also be implemented in a coaxial rod resonator, mushroom top resonator (e.g., see FIGS. 5*a* and 5*b* discussed below), or any other type or resonator.

As illustrated in the example of FIG. 4*b*, a tuning cover 405 may include one or more hollow rod(s) 420. It is noted that, in certain embodiments, the tuning cover 405 may refer to a lid of the resonator 400. According to some embodiments, the hollow rod(s) 420 can be embedded, integrated, and/or monolithic with the tuning cover 405. In other example embodiments, the hollow rod(s) 420 can be non-monolithic with, but otherwise fixed to, the tuning cover 405. For instance, the hollow rod(s) 420 may be soldered or press-fitted on to the tuning cover 405, if non-monolithic.

In one embodiment, the hollow rod(s) 420 may be provided such that tuning element 410 can be inserted into a chamber of the hollow rod(s) 420. For example, according to some embodiments, the hollow rod(s) 420 may have a threaded chamber provided therein. In an embodiment, the tuning element 410 may be screwed or threaded into the threaded chamber of the hollow rod(s) 420 of the tuning cover 405. In one embodiment, the tuning element 410 may be a dielectric tuning element.

According to certain embodiments, the tuning element 410 may include a bottom flanged portion 411. In an embodiment, the bottom flanged portion 411 may be cylindrical in shape. According to one embodiment, the tuning element 410 may be configured to be inserted into the hollow rod(s) 420 such that the bottom flanged portion 411 covers at least a bottom portion of the hollow rod(s) 420.

In an embodiment, when the tuning cover 405 is placed on top of the resonator 400, the hollow rod(s) 420 and the attached tuning element 410 may extend into the resonator hole and the bottom flanged portion 411 of the tuning element 410 may be sandwiched or positioned between the hollow rod(s) 420 of the tuning cover 405 and the inner wall 401 of the resonator 400. According to one embodiment, the bottom flanged portion 411 may be disposed such that there is a gap between the bottom flanged portion 411 and the inner wall 401. In another embodiment, the bottom flanged portion 411 may be disposed such that it fits tightly against the inner wall 401 with little or no gap.

As a result of this configuration, the capacitance between the hollow rod(s) 420 of the tuning cover 405 and the resonator 400 may be increased by the dielectric tuning element 410. For instance, the higher the dielectric constant, the stronger the capacitance and the lower the frequency. Therefore, according to example embodiments, the resonator size can be reduced for a given frequency, and the filter or multiplexer size can also be reduced. Furthermore, in certain embodiments, the tuning element 410 can be moved up and down to fine adjust the resonant frequency.

According to certain embodiments, since the hollow rod(s) 420 and tuning cover 405 are one piece, there will be no need for grounding contact at the resonator top. Also, in an embodiment, the tuning element 410 may be made of dielectric material, so that no grounding contact is needed. In this manner, the dielectric material may be configured to improve PIM performance by removing grounding contact and increasing the capacitance between the hollow rod(s) 420 and the inner wall 401 of the resonator 400. Therefore, example embodiments are able to provide excellent PIM performance using such a tuning element.

As mentioned above, the example tuning element design depicted in FIGS. 4*a* and 4*b* may also be employed in coaxial rod resonators, mushroom top resonators, and/or other top-down structure resonators to further reduce filter or multiplexer size and obtain great PIM performance.

Figure 5A:
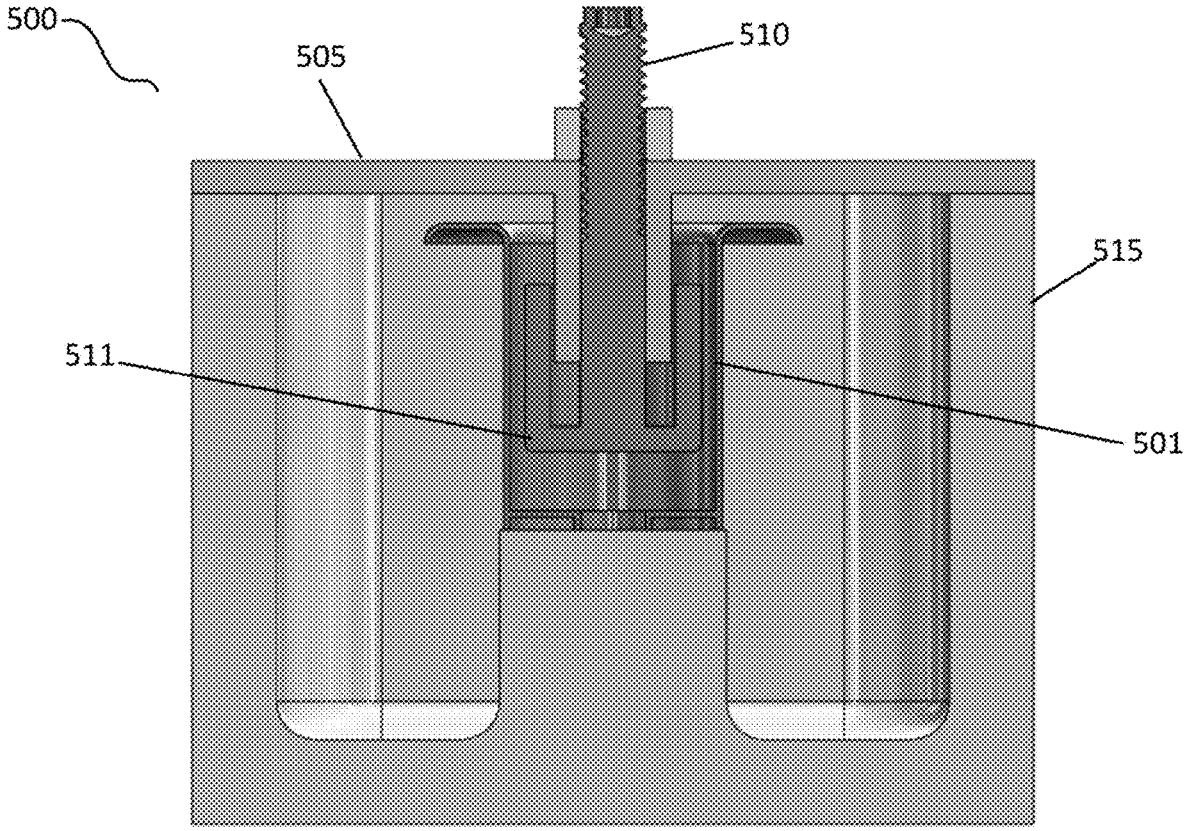
FIG. 5*a* illustrates a cross sectional view of a resonator, according to an embodiment.
Figure 5B:
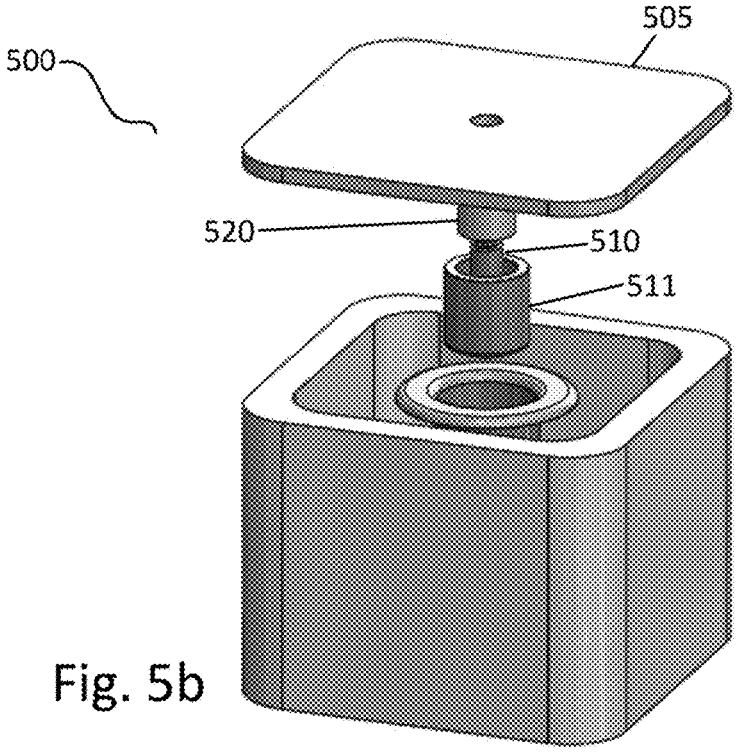
FIG. 5*b* illustrates a 3-dimensional top view of a resonator, according to an embodiment.

As another example, FIGS. 5*a* and 5*b* illustrate an embodiment applied to a mushroom top type resonator 500. For instance, FIG. 5*a* depicts a cross sectional view of a mushroom top resonator 500 and FIG. 5*b* depicts a 3-dimensional top view of the resonator 500, according to some embodiments. In one example, the mushroom top resonator 500 may include a cavity 515. In an embodiment, the resonator 500 may include a resonator hole defined within the resonator 500 and defining an inner wall 501 of the resonator 500. As noted above, example embodiments are not just limited to this type of mushroom top resonator.

As illustrated in the example of FIG. 5*b*, a tuning cover 505 may include one or more hollow rod(s) 520. As mentioned above, according to certain embodiments, the tuning cover 505 may alternately be referred to as a resonator lid. In some embodiments, the hollow rod(s) 520 may be embedded, integrated, and/or monolithic with the tuning cover 505. However, in other example embodiments, the hollow rod(s) 520 may be non-monolithic with, but otherwise fixed to, the tuning cover 505.

According to one embodiment, the hollow rod(s) 520 may be configured such that tuning element 510 can be inserted into a chamber of the hollow rod(s) 520. For instance, according to some embodiments, the hollow rod(s) 520 may have a threaded chamber provided therein. Then, in an embodiment, the tuning element 510 may be screwed or threaded into the threaded chamber of the hollow rod(s) 520 of the tuning cover 505. According to some embodiments, the tuning element 510 may be a dielectric tuning element.

According to certain embodiments, the tuning element 510 may include a bottom flanged portion 511. According to one embodiment, the tuning element 510 may be configured to be inserted into the hollow rod(s) 520 such that the bottom flanged portion 511 covers at least a bottom portion of the hollow rod(s) 520.

In an embodiment, when the tuning cover 505 is placed on top of the resonator 500, the hollow rod(s) 520 and the attached tuning element 510 may extend into the resonator hole and the bottom flanged portion 511 of the tuning element 510 may be sandwiched or positioned between the hollow rod(s) 520 of the tuning cover 505 and the inner wall 501 of the resonator 500. According to one embodiment, the bottom flanged portion 511 may be disposed such that there is a gap between the bottom flanged portion 511 and the inner wall 501. In another embodiment, the bottom flanged portion 511 may be disposed such that it fits tightly against the inner wall 501 with little or no gap.

As a result of example embodiments, the capacitance between the hollow rod(s) 520 of the tuning cover 505 and the resonator 500 can be increased by the tuning element 510. For instance, the higher the dielectric constant, the stronger the capacitance and the lower the frequency. Therefore, according to example embodiments, the resonator size can be reduced for a given frequency, and the filter or multiplexer size can also be reduced. Furthermore, in certain embodiments, the tuning element 510 can be moved up and down to fine adjust the resonant frequency.

According to certain embodiments, since the hollow rod(s) 520 and tuning cover 505 are one piece, there will be no need for grounding contact at the resonator top. Additionally, in an embodiment, the tuning element 510 may be made of dielectric material, which would mean that no grounding contact is needed. The dielectric material may be configured to improve PIM performance by removing grounding contact and increasing the capacitance between the hollow rod(s) 520 and the inner wall 501 of the resonator 500. Therefore, example embodiments are able to provide improved PIM performance using the tuning element described herein.

Figure 6A:
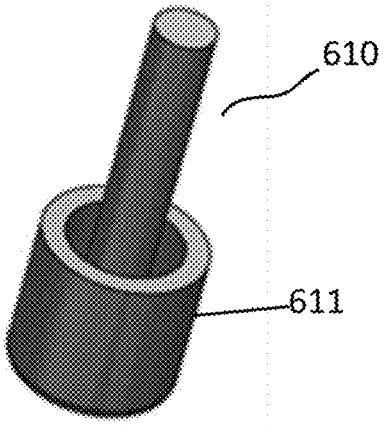
FIG. 6*a* illustrates a 3-dimensional example of a tuning element, according to an embodiment.
Figure 6B:
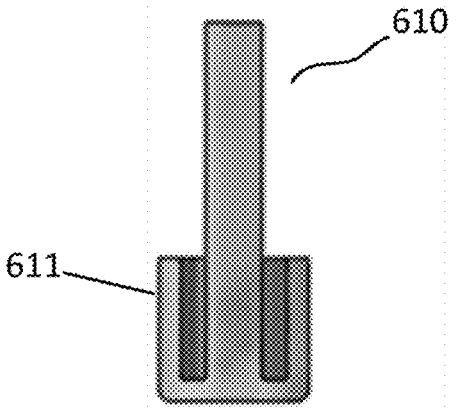
FIG. 6*b* illustrates a cross-sectional view of an example tuning element, according to an embodiment.
Figure 6C:
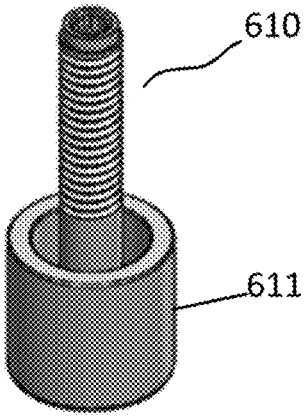
FIG. 6*c* illustrates another 3-dimensional example of a tuning element, according to an embodiment.

FIGS. 6*a*-6*c* illustrate a more detailed view of an example tuning element 610, according to some embodiments. For example, FIG. 6*a* depicts a 3-dimensional example of a tuning element 610 and FIG. 6*b* illustrates a cross-sectional view of an example tuning element 610, according to certain embodiments. FIG. 6*c* illustrates another 3-dimensional example of a tuning element 610 that may include threads or conical grooves provided thereon, according to an embodiment. In an embodiment, the tuning element 610 may be a dielectric tuning element. According to certain embodiments, the tuning element 610 may include a bottom flanged portion 611.

As mentioned above, in an embodiment, the tuning element 610 may be made of dielectric material, such that no grounding contact is needed. For instance, according to some embodiments, examples of dielectric material may include, but is not limited to, ceramic, porcelain, glass, mica, plastics, or any other material having dielectric properties.

Figure 7A:
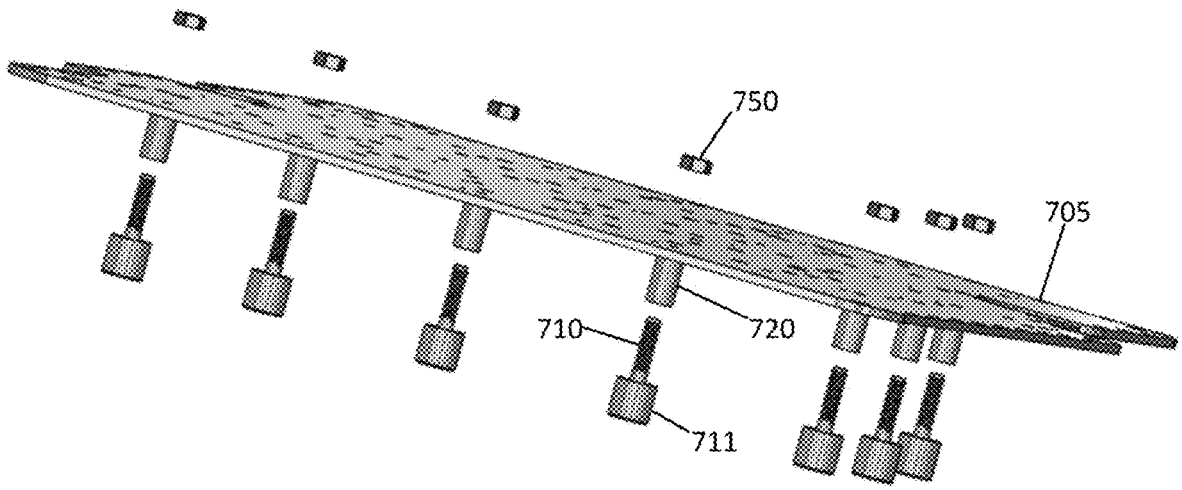
FIG. 7*a* illustrates an example of an exploded view of a tuning cover, according to an embodiment.
Figure 7B:
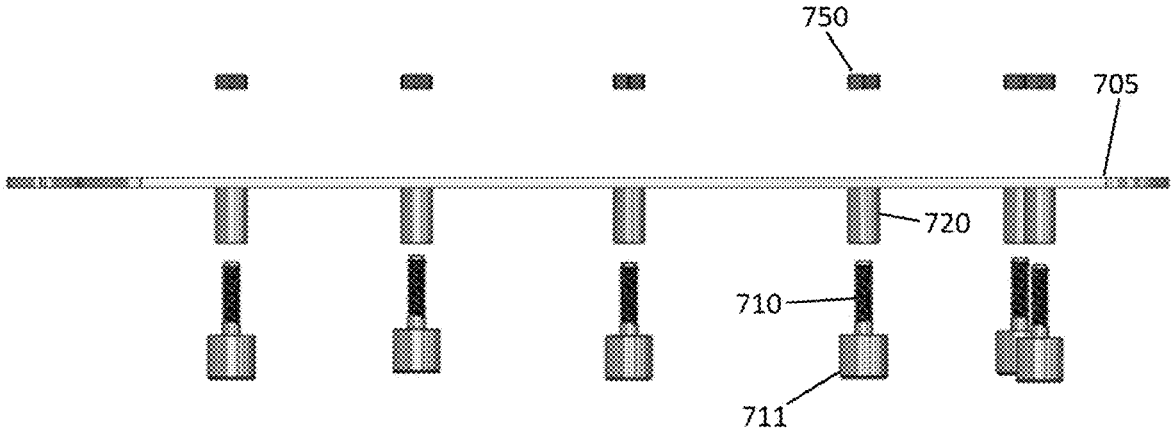
FIG. 7*b* illustrates another example of an exploded view of a tuning cover, according to an embodiment.

FIGS. 7*a* and 7*b* illustrate examples of an exploded view of a tuning cover 705 that may include one or more hollow rods 720, according to certain embodiments. As illustrated in the example of FIGS. 7*a* and 7*b*, in one embodiment, the hollow rods 720 may be configured to protrude perpendicularly from the surface of the tuning cover 705. It should be noted that the tuning cover 705 may include any number of hollow rods 720, and example embodiments are not limited to the specific configuration or number of hollow rods 720 depicted in FIGS. 7*a* and 7*b*. According to certain embodiments, the tuning cover 705 and/or hollow rods 720 may be made of any metallic material such as, but not limited to, aluminum.

In an embodiment, the hollow rods 720 may have a chamber provided therein and the chamber may be configured to accept insertion of the tuning elements 710. As discussed above, the tuning elements 710 may include a bottom flanged portion 711. In the example of FIGS. 7*a* and 7*b*, the tuning elements 710 have threads or conical grooves such that the tuning elements 710 may be screwed into the hollow rods 720. In this example, locking nuts 750 may be used to fasten the tuning elements 710 into the hollow rods 720 of the tuning cover 705. It is noted that FIGS. 7*a* and 7*b* are one example of how the tuning elements 710 may be fastened into the hollow rods 720 of the tuning cover 705. In other embodiments, the tuning elements 710 may be fastened into the hollow rods 720 by any fastening means, such as an adhesive.

Figure 8A:
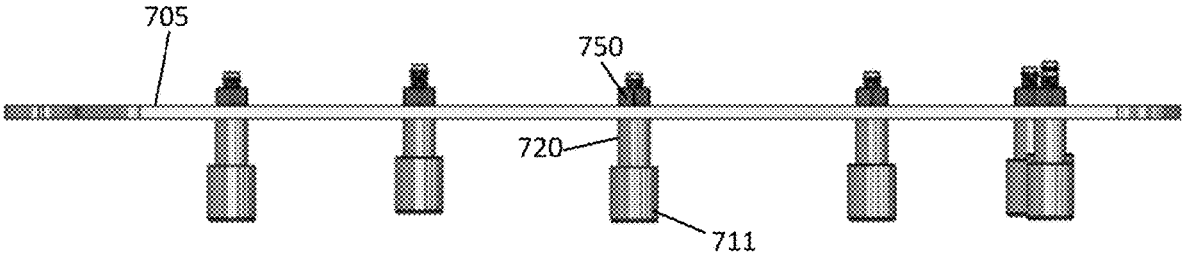
FIG. 8*a* illustrates an example of the assembled tuning cover, according to an embodiment.
Figure 8B:
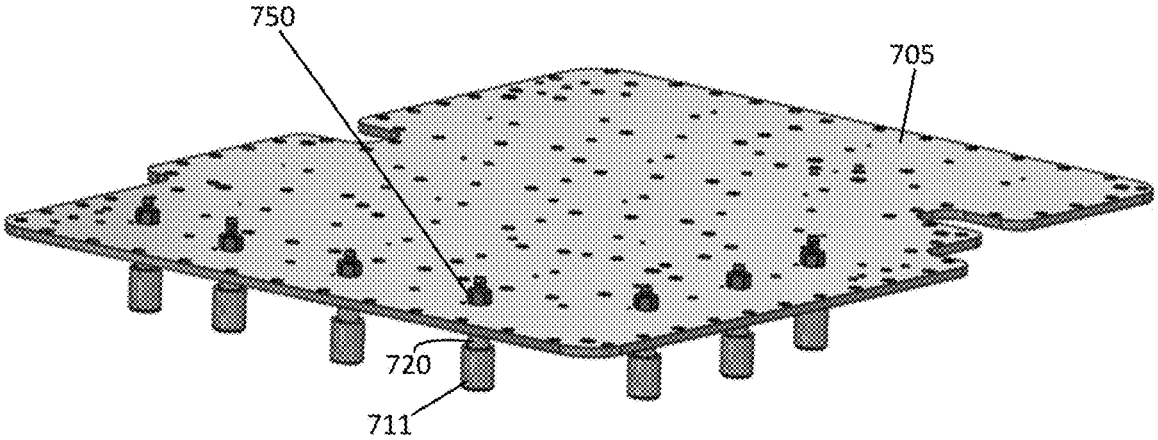
FIG. 8*b* illustrates another example of the assembled tuning cover, according to an embodiment.

FIGS. 8*a* and 8*b* illustrate an example of the assembled tuning cover 705 in which the tuning elements 710 may be fastened into the hollow rods 720 with nuts 750. It is noted that, because the hollow rods 720 and tuning cover 705 are one piece, there will be no grounding contact needed between the tuning elements 710 and tuning cover 705. As illustrated in the example of FIGS. 8*a* and 8*b*, when the tuning elements 710 are inserted into the hollow rods 720, the bottom flanged portion 711 of the tuning elements 710 may be configured to cover at least a bottom portion of the hollow rods 720.

According to certain embodiments, one or more of the resonators described herein, such as those illustrated in FIGS. 1*a*-5*b* may be included in filters or multiplexers, such as those that may be utilized for base station applications in communications systems.

Figure 9:
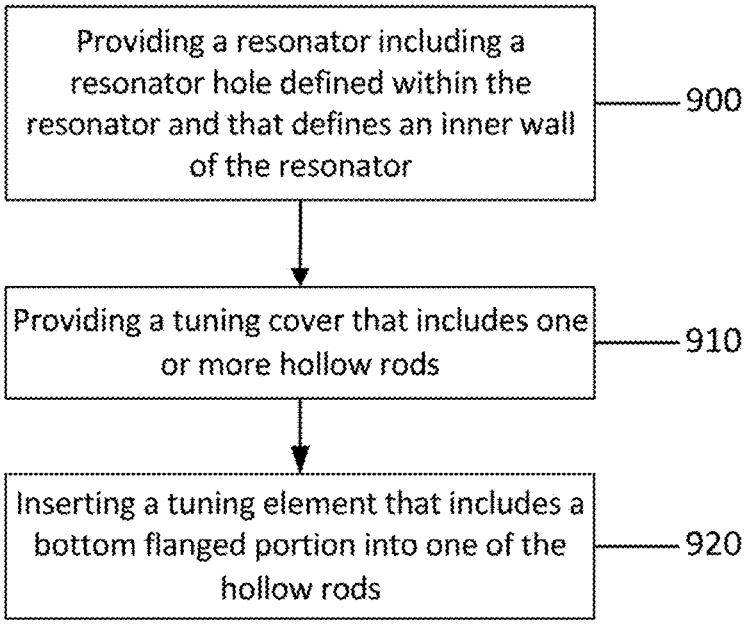
FIG. 9 illustrates an example flowchart of a method, according to an embodiment.

FIG. 9 illustrates an example flowchart diagram of a method of assembling a resonator, according to an embodiment. As illustrated in the example of FIG. 9, the method may include, at 900, providing a resonator that includes a resonator hole defined within the resonator and defining an inner wall of the resonator. The method may also include, at 910, providing a tuning cover that includes one or more hollow rods. According to certain embodiments, the hollow rods may be embedded into the tuning cover or monolithic with the tuning cover. In another embodiment, the hollow rods may be non-monolithic, but otherwise affixed to, the tuning cover. In one embodiment, the hollow rods may be disposed on the tuning cover such that they protrude perpendicularly from the surface of the tuning cover.

In certain embodiments, the method illustrated in FIG. 9 may also include, at 920, inserting a tuning element that includes a bottom flanged portion into one of the hollow rods such that the bottom flanged portion is positioned between the hollow rod and the inner wall of the resonator. According to one embodiment, the tuning element may be made of a dielectric material. In some embodiments, the dielectric material may be configured to increase PIM performance by increasing the capacitance between the hollow rod and the inner wall of the resonator hole. Thus, the tuning element may be configured to increase the capacitance between the hollow rod of the tuning cover and the resonator.

According to some embodiments, the hollow rods may have a threaded chamber formed therein, and the inserting 920 may include screwing the tuning element into the threaded chamber. In an embodiment, the method may also include moving the tuning element up and down to adjust a resonant frequency of the resonator.

Figure 10:
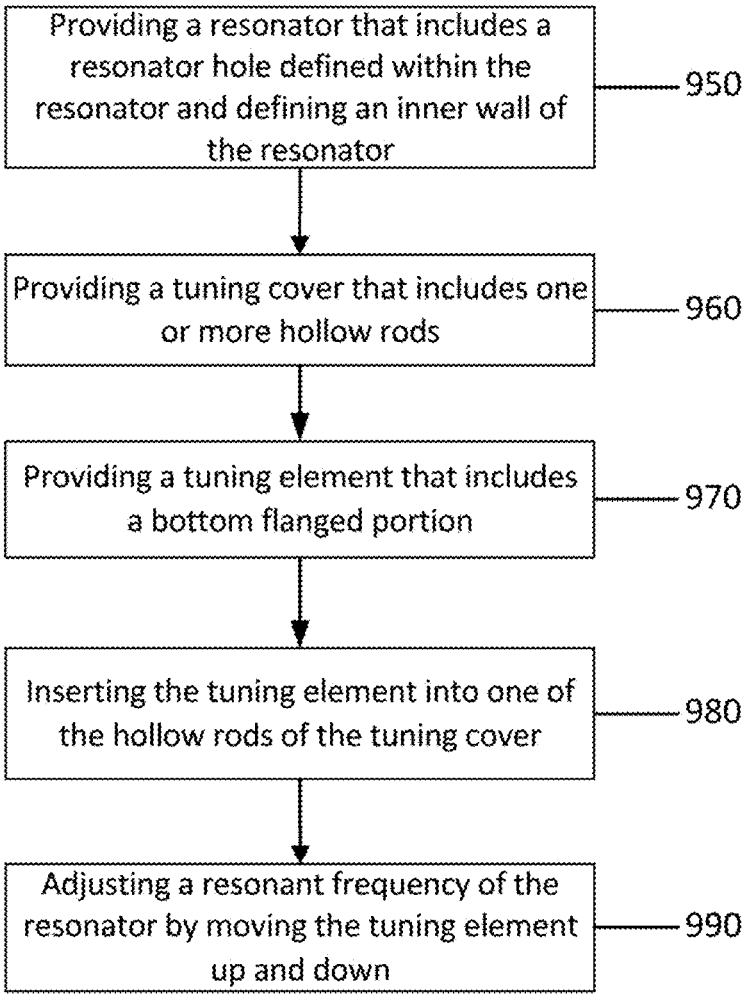
FIG. 10 illustrates an example flowchart of a method, according to an embodiment.

FIG. 10 illustrates an example flowchart diagram of a method of tuning a resonator, according to an embodiment. As illustrated in the example of FIG. 10, the method may include, at 950, providing a resonator that includes a resonator hole defined within the resonator and defining an inner wall of the resonator. The method may then include, at 960, providing a tuning cover that includes one or more hollow rods and, at 970, providing a tuning element that includes a bottom flanged portion. In an embodiment, the tuning element may be a dielectric tuning element and may be configured to increase the capacitance between the hollow rods of the tuning cover and the resonator. The method illustrated in FIG. 10 may further include, at 980, inserting the tuning element into one of the hollow rods of the tuning cover such that the bottom flanged portion of the tuning element is positioned between the hollow rod and the inner wall of the resonator. The method may then include, at 990, adjusting a resonant frequency of the resonator by moving the tuning element up and down.

Therefore, certain example embodiments provide several technological improvements, enhancements, and/or advantages over existing devices or technological processes and constitute an improvement at least to the technological fields of resonators, filters, and/or multiplexers, for example that may be used in wireless networks. For example, one advantage or improvement provided by example embodiments may include a reduction in resonator size, thereby also resulting in reduced size for filters and/or multiplexers that employ resonators. As discussed in detail above, according to certain embodiments, since the hollow rod(s) and tuning cover are one piece, there will be no grounding contact needed at the resonator top. Furthermore, since no grounding is needed according to example embodiments, improved PIM performance is achieved. It should be understood that advantages or improvements achievable by example embodiments are not merely limited to those discussed herein.

One having ordinary skill in the art will readily understand that the example embodiments as discussed above may be practiced with procedures in a different order, and/or with hardware elements in configurations which are different than those which are disclosed. Therefore, although some embodiments have been described based upon these example embodiments, it would be apparent to those of skill in the art that certain modifications, variations, and alternative constructions would be apparent, while remaining within the spirit and scope of example embodiments. In order to determine the metes and bounds of example embodiments, reference can be made to the appended claims.

We claim:

1. An apparatus, comprising:

at least one resonator comprising a resonator hole defined within the at least one resonator and defining an inner wall of the at least one resonator;

a tuning cover comprising at least one hollow rod; and a tuning element comprising a bottom flanged portion;

wherein the tuning element is configured to be inserted into the at least one hollow rod and the bottom flanged portion is configured to cover at least a bottom portion of the at least one hollow rod, and wherein the bottom flanged portion of the tuning element is configured to be positioned between the at least one hollow rod and the inner wall of the at least one resonator, wherein the bottom flanged portion of the tuning element is shaped cylindrically.

2. The apparatus according to claim 1, wherein the at least one hollow rod comprises a threaded chamber formed therein, and wherein the tuning element is configured to be screwed into the threaded chamber.

3. The apparatus according to claim 1, wherein the tuning element comprises a dielectric tuning element.

4. The apparatus according to claim 3, wherein the dielectric material is configured to improve passive intermodulation performance by removing grounding contact and increasing capacitance between the at least one hollow rod and the inner wall of the resonator hole.

5. The apparatus according to claim 1, wherein the tuning element is configured to be movable up and down to adjust a resonant frequency of the apparatus.

6. The apparatus according to claim 1, wherein the tuning element is configured to increase a capacitance between the at least one hollow rod of the tuning cover and the at least one resonator.

7. A filter comprising the apparatus according to claim 1.

8. A multiplexer comprising the apparatus according to claim 1.

9. The apparatus according to claim 1, wherein the at least one resonator comprises a mushroom top resonator.

10. The apparatus according to claim 1, wherein the at least one hollow rod is at least one of embedded into the tuning cover or monolithic with the tuning cover.

11. A method of assembling a resonator, the method comprising:

providing a resonator comprising a resonator hole defined within the resonator and defining an inner wall of the resonator;

providing a tuning cover comprising at least one hollow rod; and inserting a tuning element comprising a bottom flanged portion into the at least one hollow rod such that the bottom flanged portion is positioned between the at least one hollow rod and the inner wall of the resonator, wherein the bottom flanged portion of the tuning element is shaped cylindrically.

12. The method according to claim 11, wherein the tuning element comprises a dielectric tuning element.

13. The method according to claim 12, wherein the dielectric material is configured to improve passive intermodulation performance by removing grounding contact and increasing capacitance between the at least one hollow rod and the inner wall of the resonator hole.

14. The method according to claim 11, further comprising moving the tuning element up and down to adjust a resonant frequency of the resonator.

15. The method according to claim 11, wherein the tuning element is configured to increase a capacitance between the hollow rod of the tuning cover and the resonator.

16. The method according to claim 11, wherein the at least one hollow rod comprises a threaded chamber formed therein, and wherein the inserting comprises screwing the tuning element into the threaded chamber.

17. A method of tuning a resonator, the method comprising:

providing a resonator comprising a resonator hole defined within the resonator and defining an inner wall of the resonator;

providing a tuning cover comprising at least one hollow rod;

providing a tuning element comprising a bottom flanged portion;

inserting the tuning element into the at least one hollow rod of the tuning cover such that the bottom flanged portion of the tuning element is positioned between the at least one hollow rod and the inner wall of the resonator; and adjusting a resonant frequency of the resonator by moving the tuning element up and down, wherein the bottom flanged portion of the tuning element is shaped cylindrically.

18. The method according to claim 17, wherein the tuning element comprises a dielectric tuning element.

19. The method according to claim 17, wherein the tuning element is configured to increase a capacitance between the hollow rod of the tuning cover and the resonator.

* * * * *